United States Patent [19]

Grimes et al.

[11] Patent Number: 4,872,224

[45] Date of Patent: Oct. 10, 1989

[54] BATHTUB APPARATUS

[76] Inventors: Fred D. Grimes; Linda D. Grimes, both of 885 Fairview Ave., SE., Salem, Oreg. 97302

[21] Appl. No.: 156,414

[22] Filed: Feb. 16, 1988

[51] Int. Cl.[4] ..... A61H 33/00

[52] U.S. Cl. ..... 4/544; 4/568; 248/307; 248/215; 248/340; 128/66; 219/307

[58] Field of Search ..... 4/541, 542, 543, 544, 4/568, 605; 128/66; 248/307, 215, 340, DIG. 11; 219/284, 296, 307, 308

[56] References Cited

U.S. PATENT DOCUMENTS

| | | | |
|---|---|---|---|
| 228,722 | 6/1880 | Arnd | 4/555 |
| 1,246,190 | 11/1917 | Baudreuil | 4/568 |
| 1,339,593 | 5/1920 | Booth | 4/568 |
| 1,677,160 | 7/1928 | Woolfenden | 4/568 |
| 2,559,678 | 7/1951 | Schroeter | 128/66 X |
| 2,812,518 | 11/1957 | O'Brien et al. | 4/568 |
| 3,286,712 | 11/1966 | Roden | 128/66 |
| 3,534,730 | 10/1970 | Jacuzzi | 128/66 |
| 3,627,177 | 12/1971 | Marcus | 248/215 X |
| 3,820,173 | 6/1974 | Weller | 128/66 X |
| 3,835,846 | 9/1974 | Kurtz | 128/66 |
| 3,842,823 | 10/1974 | Jacuzzi et al. | 128/66 |
| 3,846,848 | 11/1974 | McNair | 128/66 X |
| 3,961,382 | 6/1976 | Peterson, Jr. | 128/66 |
| 4,439,877 | 4/1984 | Houle | 4/596 |
| 4,514,868 | 5/1985 | Visinand | 4/541 |
| 4,566,443 | 1/1986 | Bucher | 128/66 |
| 4,630,599 | 12/1986 | Perovick et al. | 128/16 |
| 4,655,197 | 4/1987 | Atkinson | 129/66 |
| 4,665,572 | 5/1987 | Davidson et al. | 4/541 X |
| 4,726,917 | 2/1988 | Abe | 4/542 X |
| 4,742,584 | 5/1988 | Abe | 4/542 |

FOREIGN PATENT DOCUMENTS

| | | | |
|---|---|---|---|
| 485021 | 12/1917 | France | 4/544 |

*Primary Examiner*—Frankie L. Stinson
*Attorney, Agent, or Firm*—Leon Gilden

[57] ABSTRACT

A bathtub apparatus is set forth wherein a portable module positionable overlying an associated bathtub rim includes a pump member for recirculating water through an inlet filtration pipe and selectively heating said water as desired. Included is valving for directing such water selectively through a plurality of water jets positioned in a series along a lower portion of said apparatus. The valving allows selective use of soap compartments to effect a directing of a soap solution under force into the bathtub chamber and further enables selective use of a portable spray head storable when not use within a compartment of the bathtub apparatus.

6 Claims, 4 Drawing Sheets

BATHTUB APPARATUS

BACKGROUND OF THE INVENTION

1. Field of the Invention

The field of invention relates to bathtubs and more particularly relates to a new and improved bathtub apparatus to more efficiently and effectively utilize bathing water within the bathtub for a variety of needs.

2. Description of the Prior Art

The use accessory bathtub apparatus is well known in the prior art. As may be appreciated, these devices have normally been constructed and arranged as integrally manufactured with the bathtub itself and have as such been limited in their purpose and usefulness. Accessory bathtub apparatus that has been utilized has generally been of a limited function to prevent complete usage of bathtub water. For example, U.S. Pat. No. 228,722 to Arnd presents an early attempt at modified bathtub construction wherein in addition to a conventional shower head, a head convenience storage rack and seating facilities are provided within a deeper than usual bathtub arrangement for the comfort of a user. The Arnd patent as an early attempt to enhance comfort and convenience of a bather is relatively rudimentary in the usage of any semblance of a module to effect the various convenience features of the instant invention.

U.S. Pat. No. 541,371 to Marston sets forth a bathtub arrangement wherein a thermostatically controlled plumbing arrangement enables the discontinuance of heated water thereto to raise or lower water temperature when necessary with additionally a shower or spraying device and further utilizing means for supplying fresh air in the immediate vicinity of the tub. The Marston patent is again of an integrally formed relatively cumbersome bathing organization and of limited convenience features, as compared to the instant invention.

U.S. Pat. No. 1,246,190 to Baudreuil sets forth an additional bathtub arrangement wherein an exteriorly positioned valve to the bathtub itself provides selective flow of water to a series of surrounding pipes integrally associated with a bathtub to present a spray of water within the bathtub. As in other prior devices, the patent is of relatively limited function, as compared to the instant invention, that enables the selective use of water jets with a built in filtration member along with selective heating of bathtub water with a selectively usable spray head for showering purposes and a bubble bath chamber for directing such soap into the bath water, as desired.

U.S. Pat. No. 1,339,593 to Booth sets forth a bathtub with integrally associated plumbing directed to a perimeter series of spray arrangements to effect a directed spray onto a user of an associated bathtub. Similarly, U.S. Pat. No. 1,677,160 to Woolenden further exemplifies the prior art by the integrally secured positioning of perimeter spray heads about an uppermost portion of a bathtub for the convenience of a user thereof.

U.S. Pat. No. 2,812,518 to O'Brien sets forth a portable spray unit for use with a bathtub to provide a portable spraying unit within the confines of a bathtub for the amusement and comfort of children, or for the bathing of adults.

U.S. Pat. No. 4,439,877 to Houle sets forth a shower arrangement for use with invalid tubs including a plurality of fine spray, wide angle nozzles mounted along the sides of the associated bathtub to produce a blanketing mist to cover the front of a bather. As in other prior art devices, the Houle patent is of limited function and of remote structural development as compared to the instant invention.

U.S. Pat. No. 4,514,868 to Artis sets forth a bathtub with an integrally formed jet arrangement to provide a flow of hot and cold water along the side wall of the associated bathtub in a direction to provide a circulatory movement of water therein.

As such, it may be appreciated that there is a continuing need for a new and improved bathtub apparatus which addresses both the problems of storage, portability, and selective use of a plurality of bathing enhancement features, and in this respect the present invention substantially fulfills this need.

SUMMARY OF THE INVENTION

In view of the foregoing disadvantages inherent in the known types of bathtub apparatus now present in the prior art, the present invention provides an bathtub apparatus wherein the same may be compactly stored when not in use and can be further easily and efficiently positioned operatably in association with a bathtub to effect a variety of comfort features in association with bathing. As such, the general purpose of the present invention, which will be described subsequently in greater detail, is to provide a new and improved bathtub apparatus which has all the advantages of the prior art bathtub apparatus and none of the disadvantages.

To attain this, the present invention comprises a self contained module wherein a filtered inlet draws water to the unit by means of an internally positioned pump. The pump directs fluid through a selectively operative heating coil arrangement and through a plurality of valving to enable effecting of various operative features. A water jet spray arrangement is oriented in an overlying position with respect to the module to effect a jet spray somewhat medially of the water height of the associated bathtub. A manually manipulatable shower head is positioned within a compartment of the module for selective use and furthermore compartments are positioned for containment of bathing solutions, such as bubbling soap and the like.

The instant invention thereby enables the efficient use of heated water by controlling the water temperature within the bathtub and by the filtration of various contaminants within a bathtub, such as hair and the like, limits plumbing problems associated with clogged drains. The therapeutic effects of a water jet onto a bather and optionally usable shower head and directing of bathing solutions into the bathtub during use presents a package of convenience, comfort, and economy in the conventional use of bath water.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bathing apparatus which has all the advantages of the prior art bathing apparatus and none of the disadvantages.

It is another object of the present invention to provide a new and improved bathing apparatus which may be easily and efficiently manufactured and marketed.

It is a further object of the present invention to provide a new and improved bathing apparatus which is of a durable and reliable construction.

An even further object of the present invention is to provide a new and improved bathing apparatus which is susceptible of a low cost of manufacture with regard to both materials and labor, and which accordingly is then susceptible of low prices of sale to the consuming public, thereby making such bathing apparatus economically available to the buying public.

Still yet another object of the present invention is to provide a new and improved bathing apparatus which provides in the apparatuses and methods of the prior art some of the advantages thereof, while simultaneously overcoming some of the disadvantages normally associated therewith.

Still another object of the present invention is to provide a new and improved bathing apparatus wherein a filtered intake directs water through an optionally employable heating coil by means of a pump.

Yet another object of the present invention is to provide a new and improved bathtub apparatus wherein valving is controlled to selectively utilize a jet spray arrangement, and a bathing solution means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
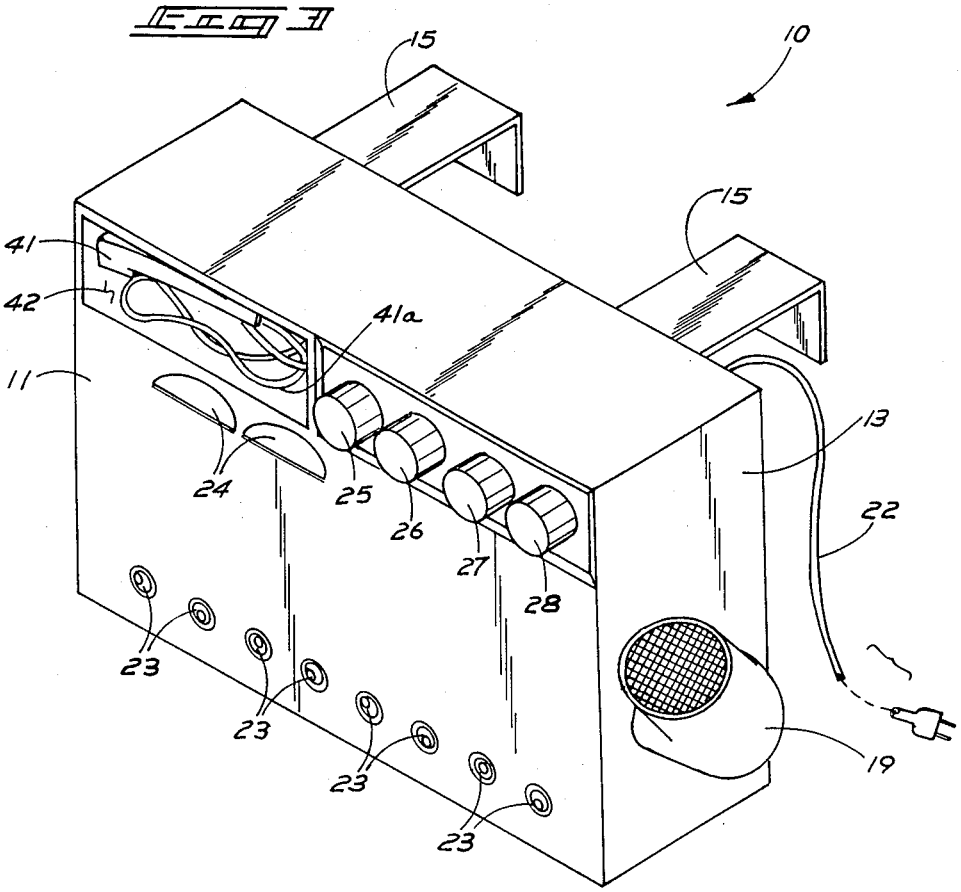
FIG. 1 is an isometric illustration of the instant invention.

With reference now to the drawings, and in particular to FIG. 1 thereof, a new and improved bathtub apparatus embodying the principles and concepts of the present invention and generally designated by the reference numeral 10 will be described.

Figure 3:
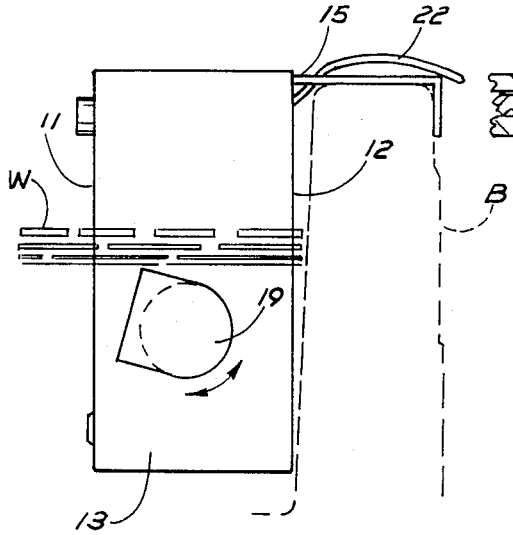
FIG. 3 is an orthographic side view of the instant invention positioned within a conventional bathtub, illustrated in phantom.
Figure 2:
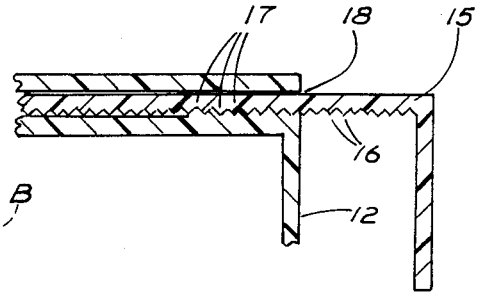
FIG. 2 is an orthographic somewhat fragemntary side view of the securement bracket of the instant invention.
Figure 6:
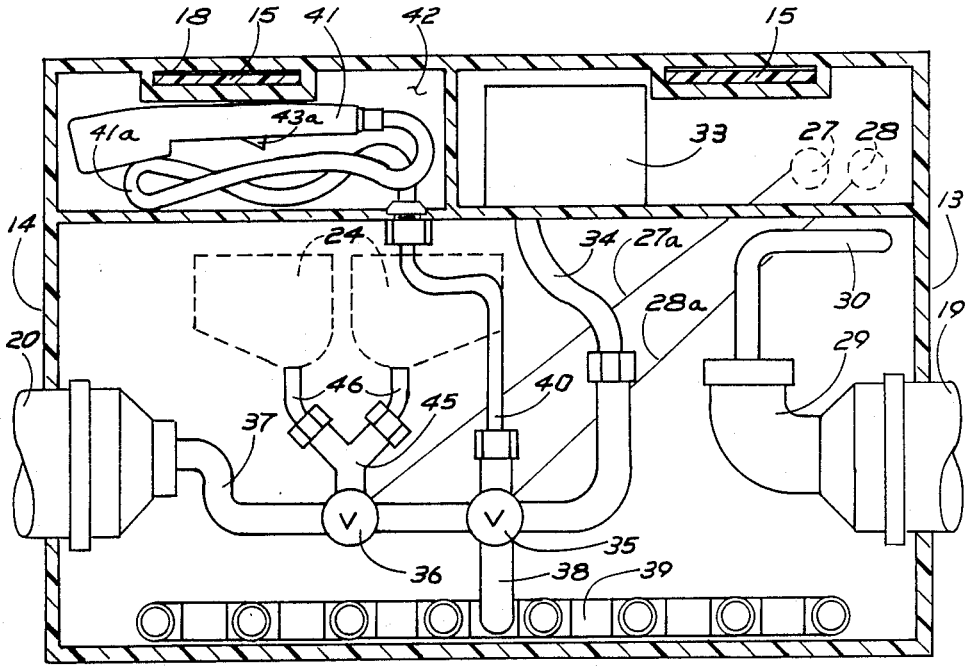
FIG. 6 is an orthographic view taken along the lines 6—6 of FIG. 4 in the direction indicated by the arrows.
Figure 7:
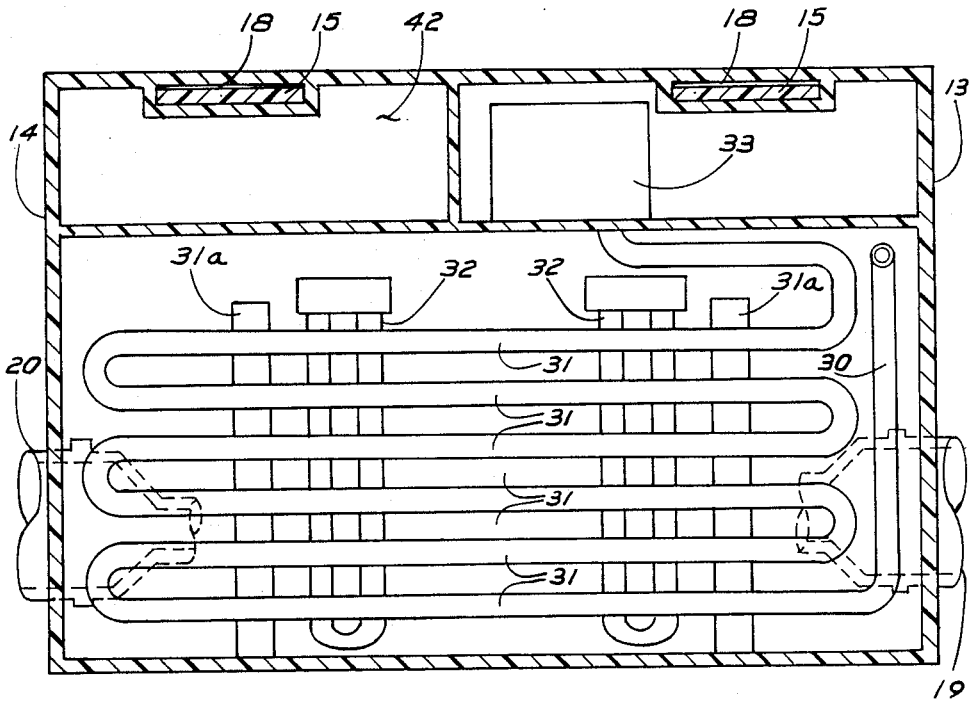
FIG. 7 is an orthographic view of the instant invention taken along the lines 7—7 of FIG. 4 in the direction indicated by the arrows.
Figure 8B:
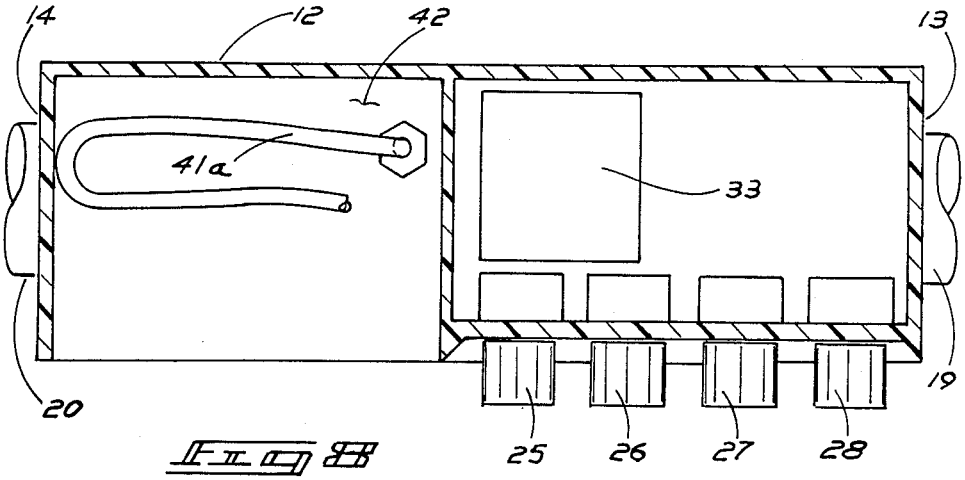
FIG. 8 is an orthographic view of the instant invention taken along the lines 8—8 of FIG. 5 in the direction indicated by the arrows.

More specifically, it will be noted that the bathtub apparatus 10 essentially comprises a cabinet structure formed with a forward wall 11, a rearward wall 12, a right side wall 13, and a left side wall 14. Extending telescopingly from rear side wall 12 are a pair of "L" shaped brackets 15 positionable within bracket compartments 18, as illustrated in FIGS. 2, 6 and 7. The brackets 15 each are formed with bracket teeth 16 cooperative with housing teeth 17 formed within the bracket compartment 18 whereby by means of the space between the "L" shaped brackets 15 and the bracket compartments 18, the brackets 15 may be positioned therealong until the proper gap between the downwardly depending legs of brackets 15 and rear wall 12 is secured to enable the appropriate positioning of the bathtub apparatus 10 onto a bathtub "B", as illustrated in FIG. 3.

Figure 4:
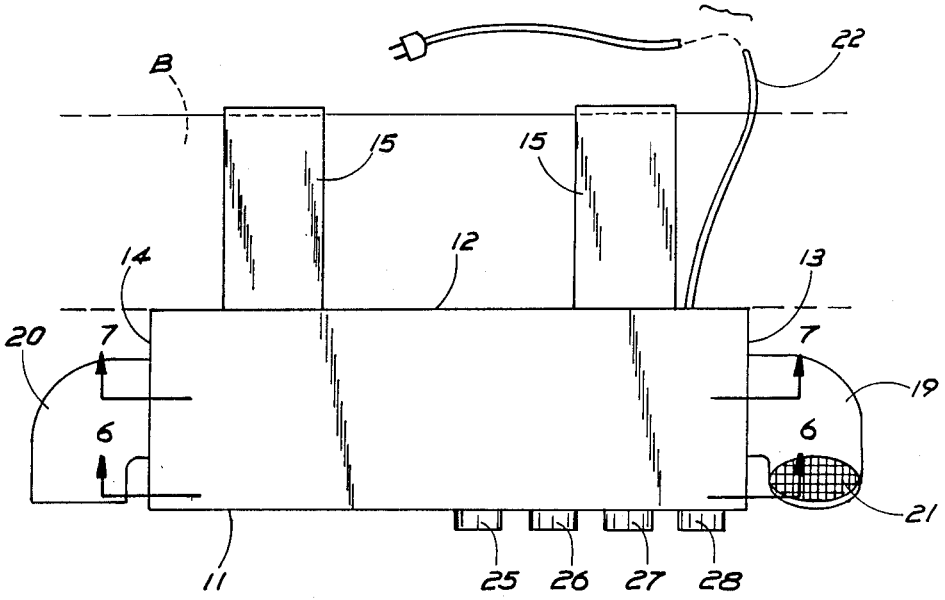
FIG. 4 is an orthographic top view of the instant invention.
Figure 5:
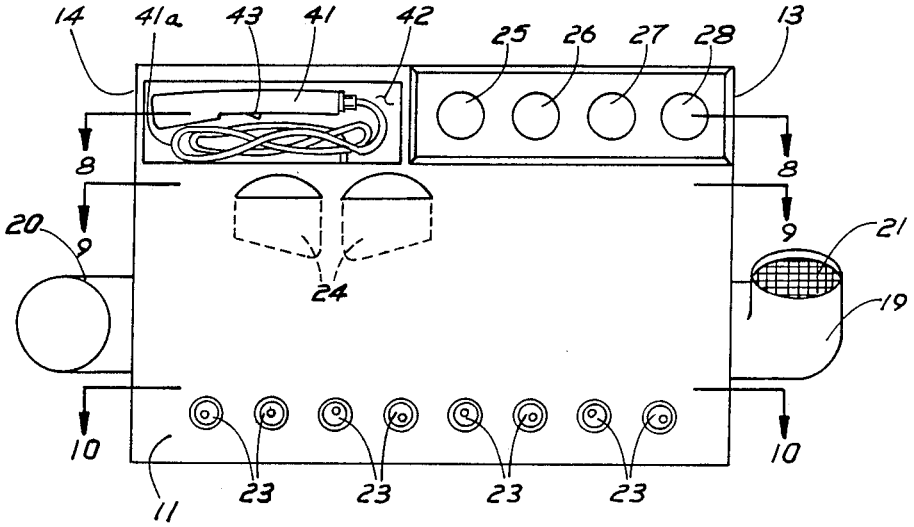
FIG. 5 is an orthographic front view taken in elevation of the instant invention.

Right side wall 13 has pivotally secured thereto an intake conduit 19, as illustrated in FIG. 1, with a pivotal outlet conduit 20 secured to left side wall 14, as illustrated in FIGS. 4 and 5, for example. The pivotal adjustment of the intake and outlet conduits 19 and 20 respectively enable the appropriate positioning of the conduit with respect to a water level "W", as illustrated in FIG. 3. A removable filter screen 21 for cleaning purposes is positioned within intake conduit 19 to strain contaminants from the water and prevent their potential clogging of drainage systems of typical plumbing arrangements.

As illustrated in FIG. 1, a power supply core 22 delivers power to the internal components of the water proof compartment of the bathtub apparatus 10, to be described in more detail. Positioned on forward wall 11 are a plurality of control knobs, such as on/off switch 25, a heat on/off switch 26, and ingredient chamber valve switch 27, and a shower and jet valve switch 28. Positioned in a lower lying orientation on forward wall 11 are a series of pivotally directable water jets 23 for delivering a therapeutic stream of water onto a bather, as desired. Overlying the pivotally mounted water jets 23 are a plurality of bathing ingredient chambers 24 into which a bather may deposit a quantity of bathing solutions, such as soaps, oils, and the like. Positioned in uppermost portion of forward wall 11 is a shower head compartment 42 wherein a shower head 41 is positioned supplied by a flexible conduit 41*a*.

Figure 9:
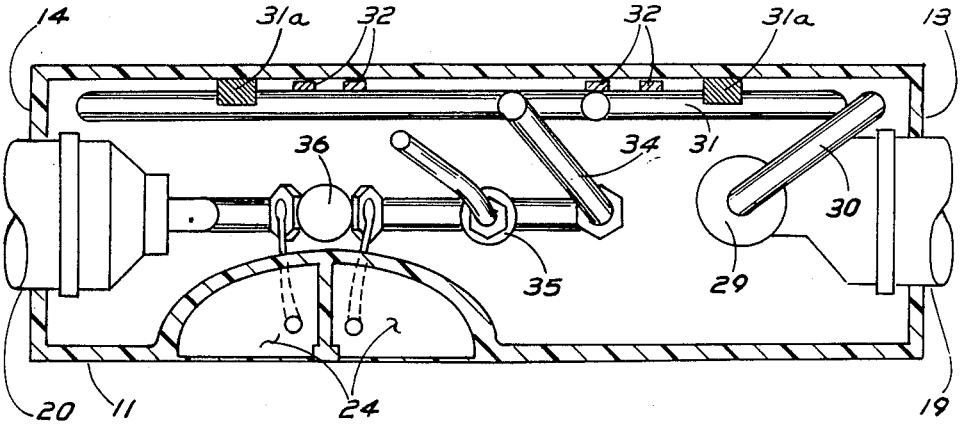
FIG. 9 is an orthographic view of the instant invention taken along the lines 9—9 of FIG. 5 in the direction indicated by the arrows.

Attention to FIGS. 6 and 9 illustrates the intake conduit 19 directed inwardly to a reducer elbow 29 and to a reduction inlet 30 directed to a serpentine conduit coil series 31 leading to pump 33 actuatable by on/off switch 25. The serpentine coil 31 is secured within the bathtub apparatus 10 by a plurality of support brackets 31*a* to maintain the integrity and positioning of the coil within the bathtub apparatus. A plurality of resistance heaters 32 are positioned contiguously along the serpentine coil 31 for selective heating of the inlet water and energizable by the heat on/off switch 26 by conventional circuitry.

Figure 10:
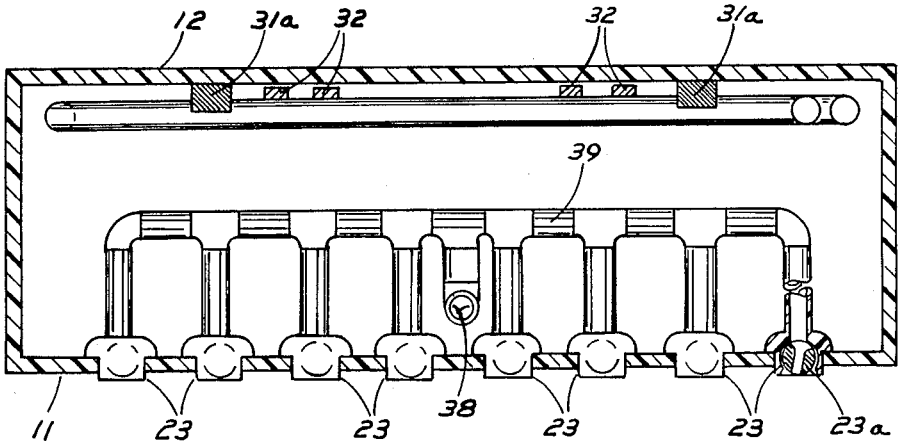
FIG. 10 is an orthographic view of the instant invention taken along the lines 10—10 of FIG. 5 in the direction indicated by the arrows.

Directed from pump 33 under pressure is fluid through pump outlet pipe 34 into first valve 35. First valve 35 is actuatable by switch 28 to pass water therealong to second valve 36 or optionally to the shower head 41 through shower supply conduit 40. The water directed therethrough and through flexible conduit 41*a* enables a bather to utilize the portable shower and direct water outwardly therefrom through the shower head valve 43 conveniently positioned on the shower head 41. First valve 35 simultaneously directs water through water jet supply conduit 38 into water manifold 39 to direct water through the series of pivotally mounted water jets 23. As illustrated in FIG. 10, the jets may be directly oriented, as illustrated by the pivotal valving 23*a* included within the jet structure. Second valve 36 actuatable by ingredient chamber valve 27 through control line 27*a* wherein first valve 35 is controlled by switch 28 through control line 28*a* to conventionally mechanically open and close the respective valves 35 and 36. Upon opening valve 36, water is directed under pressure through the "Y" fitting 45 and ingredient chamber supply conduits 46 into the bathing ingredient chambers 24 to direct bathing ingredients, as desired by a bather, into the bath water.

An outlet pipe 37 positioned between second valve 36 and outlet conduit 20 directs water to the outlet 20 with a flow therefrom dependent upon the selective use of valves 35 and 36.

As to the manner of usage and operation of the present invention, the same should be apparent from the above description. Accordingly, no further discussion relative the matter of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A bathtub apparatus for use in combination with a bathtub container including top and bottom walls, right and left end walls, a rear wall, and a forward wall to define a module, said apparatus comprises, a securement means adjustably extending outwardly from said rear wall for securement of said module to an encircling wall of said bathtub;

a fluid inlet conduit means secured to said right wall directed inwardly of said module to an inlet pipe;

said inlet pipe in contiguous position proximate a selectively operative heating means for heating fluid directed through said inlet pipe;

a selectively operative pump means positioned to accept water from said inlet pipe for directing water under pressure to an outlet pipe within said module;

a discharge conduit operatably connected to said outlet pipe to direct fluid outwardly of said module into said bathtub container;

said securement means includes a plurality of "L" shaped brackets telescopingly directed from said rear wall and formed with teeth cooperative with housing teeth formed within said module to adjustably position said bracket relative to said module;

said inlet conduit means is directed to said inlet pipe by a reducer to reduce the cross-sectional area of flow from said inlet conduit means to said inlet pipe;

said inlet pipe includes a serpentine coil operatably associated with said heating means to effectively heat fluid within said serpentine pipe, and including a first valve means positioned between said pump means and said discharge conduit selectively operative to direct water to said discharge conduit or to a plurality of adjustably orientable water jets operatably associated with said first valve through an elongate water manifold wherein said water jets are positioned proximate a lower edge of said forward wall.

2. A bathtub apparatus as set forth in claim 1 wherein said first valve is further operatably associated with a manually manipulatable shower head positionable with a compartment within said module to enable selective use of said shower head.

3. A bathtub apparatus as set forth in claim 2 wherein a second valve is positioned between said first valve and said discharge conduit and said second valve is operatably associated through a "Y" connection to a plurality of bathtub ingredient chambers formed within said forward wall for acceptance of bathtub ingredients including bath oils, bath salts, and the like.

4. A bathtub apparatus as set forth in claim 3 wherein said inlet conduit and said discharge conduit are pivotally secured to said right and left walls respectively.

5. A bathtub apparatus as set forth in claim 4 wherein said inlet conduit has removably positionable therein a filtration screen for filtration of contaminants within said water.

6. A bathtub apparatus as set forth in claim 1 wherein said module is waterproof.

* * * * *